US010126030B2

(12) United States Patent
Kim et al.

(10) Patent No.: US 10,126,030 B2
(45) Date of Patent: Nov. 13, 2018

(54) HEAT EXCHANGER AND HEAT PUMP HAVING THE SAME

(71) Applicants: LG ELECTRONICS INC., Seoul (KR); IUCF-HYU(INDUSTRY-UNIVERSITY COOPERATION FOUNDATION HANYANG UNIVERSITY), Seoul (KR)

(72) Inventors: Seh Yeon Kim, Seoul (KR); Jin Sung Park, Daejeon (KR); Kwan Soo Lee, Seoul (KR)

(73) Assignees: LG ELECTRONICS INC., Seoul (KR); IUCF-HYU(INDUSTRY-UNIVERSITY COOPERATION FOUNDATION HANYANG UNIVERSITY), Seoul (KR)

( * ) Notice: Subject to any disclaimer, the term of this patent is extended or adjusted under 35 U.S.C. 154(b) by 0 days.

(21) Appl. No.: 15/326,989

(22) PCT Filed: Jul. 16, 2015

(86) PCT No.: PCT/KR2015/007419
§ 371 (c)(1),
(2) Date: Jan. 17, 2017

(87) PCT Pub. No.: WO2016/010389
PCT Pub. Date: Jan. 21, 2016

(65) Prior Publication Data

US 2017/0198954 A1 Jul. 13, 2017

(30) Foreign Application Priority Data

Jul. 17, 2014 (KR) ..... 10-2014-0090601

(51) Int. Cl.
*F25B 47/00* (2006.01)
*F25B 30/00* (2006.01)
(Continued)

(52) U.S. Cl.
CPC ..... *F25B 47/006* (2013.01); *F25B 13/00* (2013.01); *F25B 30/00* (2013.01);
(Continued)

(58) Field of Classification Search
CPC ..... F25B 47/006; F28F 1/325; F28F 2215/08; F28D 1/05383
See application file for complete search history.

(56) References Cited

U.S. PATENT DOCUMENTS 6,308,527 B1 10/2001 Kuroyanagi et al.
2009/0173478 A1* 7/2009 Beamer ..... F25B 39/02 165/151
(Continued)

FOREIGN PATENT DOCUMENTS

EP 2236972 A2 10/2010
EP 2653819 A1 10/2013
(Continued)

*Primary Examiner* — Emmanuel Duke
(74) *Attorney, Agent, or Firm* — Dentons US LLP

(57) ABSTRACT

A heat exchanger having a plurality of first tubes and second tubes through which a refrigerant passes and which are lengthily formed up and down, each of the first and second tubes being spaced from each other and air flowing between the tubes; and a fin in contact with the first and second tubes, wherein the second tubes are spaced from each other and located at a slipstream of the first tubes in an air-flow direction, a first louver group having a plurality of louvers located between the first tubes and spaced from each other in the air-flow direction and a second louver group having a plurality of louvers located between the second tubes and spaced from each other in the air-flow direction are formed in the fin, wherein some of the louvers of the second louver
(Continued)

group are longer toward the slipstream of the air-flow direction.

4 Claims, 6 Drawing Sheets

(51) Int. Cl.

| | |
|---|---|
| ***F28F 1/10*** | (2006.01) |
| ***F28F 1/30*** | (2006.01) |
| ***F28F 1/32*** | (2006.01) |
| ***F25B 13/00*** | (2006.01) |
| ***F28D 1/053*** | (2006.01) |
| ***F28F 1/12*** | (2006.01) |

(52) U.S. Cl.
CPC ..... *F28D 1/05383* (2013.01); *F28F 1/10* (2013.01); *F28F 1/128* (2013.01); *F28F 1/30* (2013.01); *F28F 1/32* (2013.01); *F28F 1/325* (2013.01); *F28F 2215/02* (2013.01); *F28F 2215/08* (2013.01); *H05K 999/99* (2013.01)

(56) References Cited

U.S. PATENT DOCUMENTS

| | | | | |
|---|---|---|---|---|
| 2009/0282850 | A1* | 11/2009 | Higashiyama ..... | F25B 39/02 62/239 |
| 2010/0243226 | A1* | 9/2010 | Huazhao ..... | F28F 1/128 165/182 |
| 2013/0299152 | A1* | 11/2013 | Ohtani ..... | F28D 1/05383 165/181 |

FOREIGN PATENT DOCUMENTS

| | | | |
|---|---|---|---|
| JP | 2004-271113 | A | 9/2004 |
| JP | 2012-154496 | A | 8/2012 |
| KR | 10-0821180 | B1 | 4/2008 |
| KR | 10-0833479 | B1 | 5/2008 |
| KR | 10-2014-0065651 | A | 5/2014 |

* cited by examiner

HEAT EXCHANGER AND HEAT PUMP HAVING THE SAME

This application is a National Stage Application of International Application No. PCT/KR2015/007419 filed on Jul. 16, 2015, which claims the benefit of Korean Patent Application No. 10-2014-0090601 filed on Jul. 17, 2014, all of which are hereby incorporated by reference in their entirety for all purposes as if fully set forth herein.

TECHNICAL FIELD

The present invention relates to a heat exchanger and a heat pump including the same and, more particularly, to a heat exchanger having louvers formed therein and a heat pump including the same.

BACKGROUND ART

In general, a heat exchanger is an apparatus for moving heat between two fluids and is widely used for cooling, heating, and hot water.

The heat exchanger may function as a waste heat recovery heat exchanger for recovering waste heat, may function as a cooler for cooling a high temperature-side fluid, may function as a heater for heating a low temperature-side fluid, may function as a condenser for condensing a refrigerant or may function as an evaporator for evaporating a refrigerant.

The heat exchanger may be used in a heat pump, that is, a cooling and heating apparatus for transferring a heat source of a low temperature at a high temperature using the generation of heat or condensation heat of a refrigerant or transferring a heat source of a high temperature at a low temperature.

The heat pump may include a compressor, a heating and cooling switchover valve, an outdoor heat exchanger, an expansion device, and an indoor heat exchanger. In the heat pump, upon cooling operation, a refrigerant may flow in order of the compressor, the heating and cooling switchover valve, the outdoor heat exchanger, the expansion device, the indoor heat exchanger, the heating and cooling switchover valve, and the compressor. In the heat pump, upon heating operation, a refrigerant may flow in order of the compressor, the heating and cooling switchover valve, the indoor heat exchanger, the expansion device, the outdoor heat exchanger, the heating and cooling switchover valve, and the compressor.

In the heat pump, in a heating operation of a low temperature in which an outside temperature is low, frost can be easily attached to the outdoor heat exchanger due to outdoor air of a low temperature. The heat pump may include a separate defrosting heater for heating the outdoor heat exchanger. Accordingly, in a condition in which excessive frost is attached to the outdoor heat exchanger, the heat pump can remove frost attached to the outdoor heat exchanger by heating the outdoor heat exchanger using the defrosting heater. Meanwhile, upon heating operation, in a condition in which excessive frost is attached to the outdoor heat exchanger, the heat pump can remove the frost of the outdoor heat exchanger by performing a defrosting operation for changing the direction in which a refrigerant flows as in a cooling operation.

DISCLOSURE

Technical Problem

A heat exchanger according to a conventional technology is problematic in that frost can be chiefly attached to louvers that belong to a plurality of louvers and that are located at the front in the direction in which air flows because the interval between the louvers is constant in the direction in which air flows, the attached frost can hinder a flow of air, and frequent defrosting is required.

Technical Solution

The present invention includes a plurality of first tubes and a plurality of second tubes through which a refrigerant passes therein and which are lengthily formed up and down, each of the first tubes and the second tubes being spaced apart from each other and air flowing between the tubes and a fin coming into contact with the first tube and the second tube. The plurality of second tubes is spaced apart from each other and located at the slipstream of the plurality of first tubes in the direction in which air flows. A first louver group including a plurality of louvers located between the plurality of first tubes and spaced apart from each other in the direction in which air flows and a second louver group including a plurality of louvers located between the plurality of second tubes and spaced apart from each other in the direction in which air flows are formed in the fin. An interval between adjacent louvers of the plurality of louvers of the first louver group is gradually narrowed toward a slipstream of the direction in which air flows.

The interval between the plurality of louvers of the first louver group may be gradually reduced at a ratio of 10% to 20% toward the slipstream of the direction in which air flows.

The plurality of louvers of the first louver group may guide air in an upward slope direction, and the plurality of louvers of the second louver group may guide air in a downward slope direction.

Some of the plurality of louvers of the first louver group may have a length which is shorter toward the slipstream of the direction in which air flows.

An interval between adjacent louvers of the plurality of louvers of the second louver group may be gradually widened toward the slipstream of the direction in which air flows.

Some of the plurality of louvers of the second louver group may have a length which is longer toward the slipstream of the direction in which air flows.

The present invention includes a tube through which a refrigerant passes therein; and a fin coming into contact with the tube. A plurality of louvers spaced apart from each other in the direction in which air flows is formed in the fin, and an interval between adjacent louvers of the plurality of louvers may be gradually reduced toward a slipstream of the direction in which air flows.

The interval between the plurality of louvers may be gradually reduced at a ratio of 10% to 20% toward the slipstream of the direction in which air flows.

Some of the plurality of louvers may have a length which is shorter toward the slipstream of the direction in which air flows.

The present invention includes a compressor which compresses a refrigerant; an outdoor heat exchanger which thermally exchanges the refrigerant with outside air; an indoor heat exchanger which thermally exchanges the refrigerant with indoor air; an expansion device which is disposed between the heat exchanger and the indoor heat exchanger; and a cooling and heating switchover valve which runs the refrigerant compressed by the compressor toward the heat exchanger or toward the indoor heat exchanger. The outdoor heat exchanger a plurality of first tubes and a plurality of second tubes through which a refrigerant passes therein and which are lengthily formed up and down, each of the first tubes and the second tubes being spaced apart from each other and outside air flowing between the tubes and a fin coming into contact with the first tube and the second tube. The plurality of second tubes is spaced apart from each other and located at the slipstream of the plurality of first tubes in the direction in which outside air flows. A first louver group including a plurality of louvers located between the plurality of first tubes and spaced apart from each other in the direction in which outside air flows and a second louver group including a plurality of louvers located between the plurality of second tubes and spaced apart from each other in the direction in which outside air flows are formed in the fin. An interval between adjacent louvers of the plurality of louvers of the first louver group may be gradually narrowed toward a slipstream of the direction in which outside air flows.

The interval between the plurality of louvers of the first louver group may be gradually reduced at a ratio of 10% to 20% toward the slipstream of the direction in which outside air flows.

The plurality of louvers of the first louver group may guide outside air in an upward slope direction, and the plurality of louvers of the second louver group may guide outside air in a downward slope direction.

Some of the plurality of louvers of the first louver group may have a length which is shorter toward the slipstream of the direction in which outside air flows.

An interval between adjacent louvers of the plurality of louvers of the second louver group may be gradually widened toward the slipstream of the direction in which outside air flows.

Some of the plurality of louvers of the second louver group may have a length which is longer toward the slipstream of the direction in which outside air flows.

Advantageous Effects

The present invention has an advantage in that the blocking of a flow of air attributable to frost generated at the front of the heat exchanger in the direction in which air flows can be delayed.

Furthermore, the present invention has advantages in that it can delay the time taken for the heat pump to operate as a defrosting operation to a maximum extent, can improve heating efficiency, and can minimize consumption power.

MODE FOR INVENTION

Hereinafter, embodiments of the present invention are described in detail with reference to the accompanying drawings.

Figure 1:
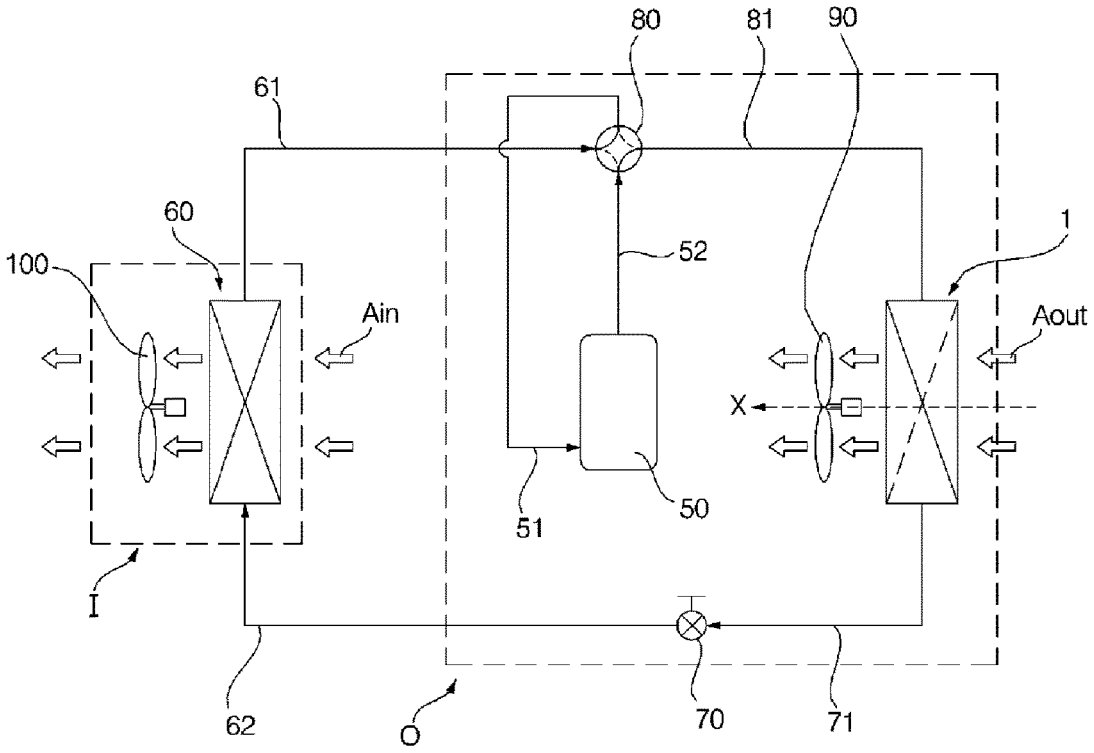
FIG. 1 shows the configuration of a heat pump to which an embodiment of a heat exchanger according to the present invention has been applied.

FIG. 1 shows the configuration of a heat pump to which an embodiment of a heat exchanger according to the present invention has been applied.

The heat pump of the present embodiment includes an outdoor heat exchanger 1 which thermally exchanges an outside air Aout and a refrigerant, a compressor 50 which compresses the refrigerant, an indoor heat exchanger 60 which thermally exchanges an indoor air Ain and the refrigerant, and an expansion device 70 which is disposed between the outdoor heat exchanger 1 and the indoor heat exchanger 60 and expands the refrigerant. The heat pump further includes a cooling and heating switchover valve 80 which may supply the refrigerant, compressed by the compressor 50, to the outdoor heat exchanger 1 or supply the compressed refrigerant to the indoor heat exchanger 60. The heat pump may further include an outside fan 90 which ventilates the outside air Aout toward the outdoor heat exchanger 1 and an indoor fan 100 which ventilates the indoor air Ain toward the indoor heat exchanger 60.

The outdoor heat exchanger 1 may include a tube through which the refrigerant passes and a fin-tube type heat exchanger including fins brought into contact with the tube. A louver may be formed in the fin of the outdoor heat exchanger 1.

A compressor suction flow channel 51 through which the refrigerant flowing in the cooling and heating switchover valve 80 is sucked toward the compressor 50 may be connected to the compressor 50. A compressor flow channel 52 through which the refrigerant compressed by the compressor 50 is discharged toward the cooling and heating switchover valve 80 may be connected to the compressor 50.

The indoor heat exchanger 60 may be connected to the cooling and heating switchover valve 80 by an indoor heat exchanger-cooling and heating switchover valve connection flow channel 61.

The indoor heat exchanger 60 may be connected to the expansion device 70 by an indoor heat exchanger-expansion device connection flow channel 62.

The expansion device 70 may be connected to the outdoor heat exchanger 1 by an expansion device-outdoor heat exchanger connection flow channel 71.

The cooling and heating switchover valve 80 may be connected to an outdoor heat exchanger 1 by an outdoor heat exchanger-cooling and heating switchover valve connection flow channel 81.

The heating and cooling switchover valve 80 may have cooling mode in which the refrigerant compressed by the compressor 50 is guided into the outdoor heat exchanger 1 and the refrigerant evaporated by the indoor heat exchanger 60 is guided into the compressor 50. The heating and cooling switchover valve 80 may have heating mode in which the refrigerant compressed by the compressor 50 is guided into the indoor heat exchanger 60 and the refrigerant evaporated by the outdoor heat exchanger 1 is guided into the compressor 50.

The indoor heat exchanger 60 and the indoor fan 100 may be together located in an indoor unit I. The compressor 50, the outdoor heat exchanger 1, and the outside fan 90 may be together disposed in an outdoor unit O. The expansion device 70 may be located in at least one of the indoor unit I and the outdoor unit O.

In the heat pump, the outdoor heat exchanger 1 may become a defrosting condition during a cooling operation. In such a case, the heat pump may perform a defrosting operation in which heating mode switches to cooling mode. In the defrosting operation of the heat pump, the heating and cooling switchover valve 80 may be cooling mode, so a refrigerant of a high temperature and high pressure compressed by the compressor 60 may flow into the outdoor heat exchanger 1 and then may be defrosted. When the defrosting of the outdoor heat exchanger 1 of the heat pump is completed, the heating and cooling switchover valve 80 may switch to heating mode, and thus the heat pump may switch to a cooling operation again and operate. The heat pump may alternately perform a cooling operation and a defrosting operation depending on the defrosting condition or defrosting completion condition of the outdoor heat exchanger 1.

In the heat pump, the number of defrosting operations may be increased as the time taken for the outdoor heat exchanger 1 reaches the defrosting condition is reduced, and consumption power may be increased due to frequent defrosting operations.

If all of the intervals between louvers formed in the outdoor heat exchanger 1 are constant, frost may be chiefly attached to the front part of the outdoor heat exchanger 1 in the direction in which the outside air Aout flows. The frost attached to the front part of the outdoor heat exchanger 1 may hinder the suction of the outside air. If frost is not concentrated on the front part of the outdoor heat exchanger 1 in the direction in which the outside air Aout flows, the time that a defrosting operation starts can be delayed to a maximum extent, efficiency of an overall cooling operation can be improved, and consumption power can be minimized because the number of defrosting operations is reduced.

In the outdoor heat exchanger 1, if the interval between louvers approximately located at the front part in the direction X in which the outside air flows in the outdoor heat exchanger 1 is wide and the interval between louvers located after the louvers located at the front part is relatively narrow, the amount of frost attached to the louvers located at the front part may be reduced and the amount of frost attached to the louvers located at the back may be relatively increased. In this case, the outdoor heat exchanger 1 can minimize a phenomenon in which the frost attached to the louvers at the front part is extended to hinder a flow of the outside air.

The outdoor heat exchanger 1 is hereinafter referred to as the heat exchanger 1 and described.

Figure 2:
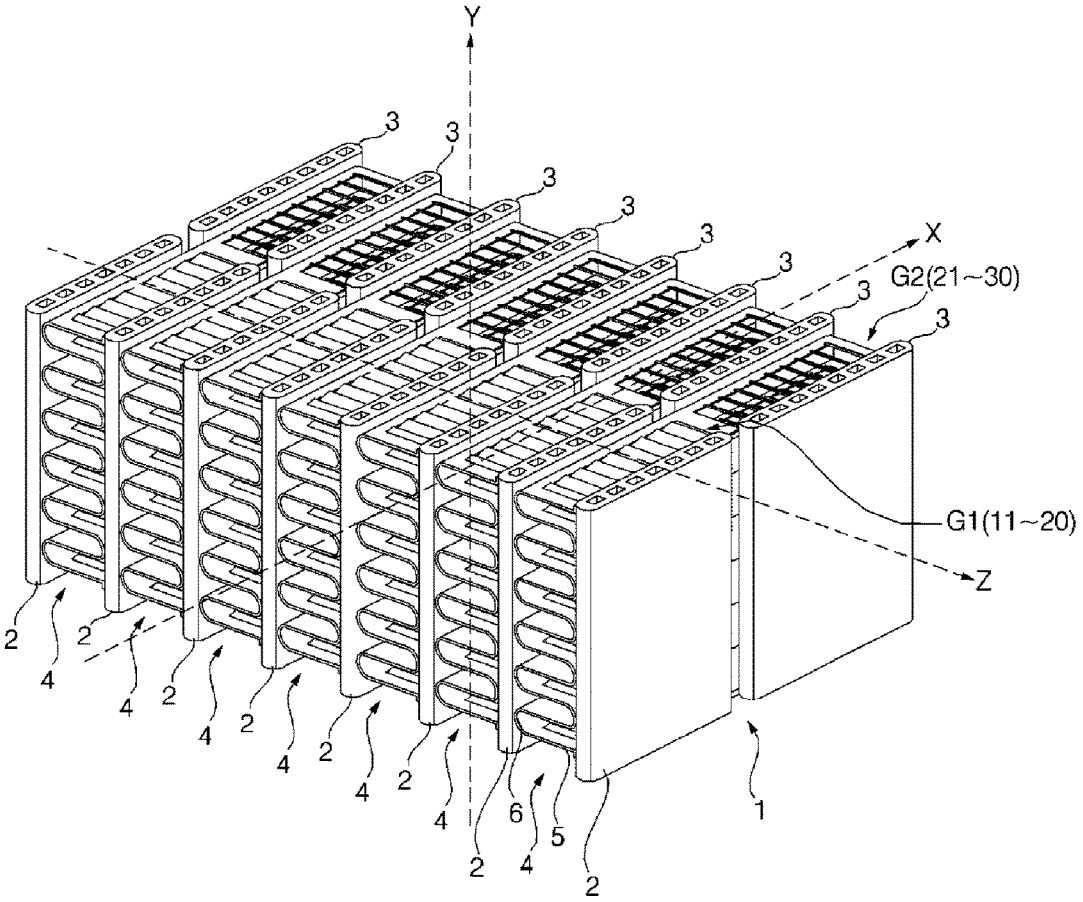
FIG. 2 is a partially cut-away perspective view of an embodiment of the heat exchanger according to the present invention.
Figure 3:
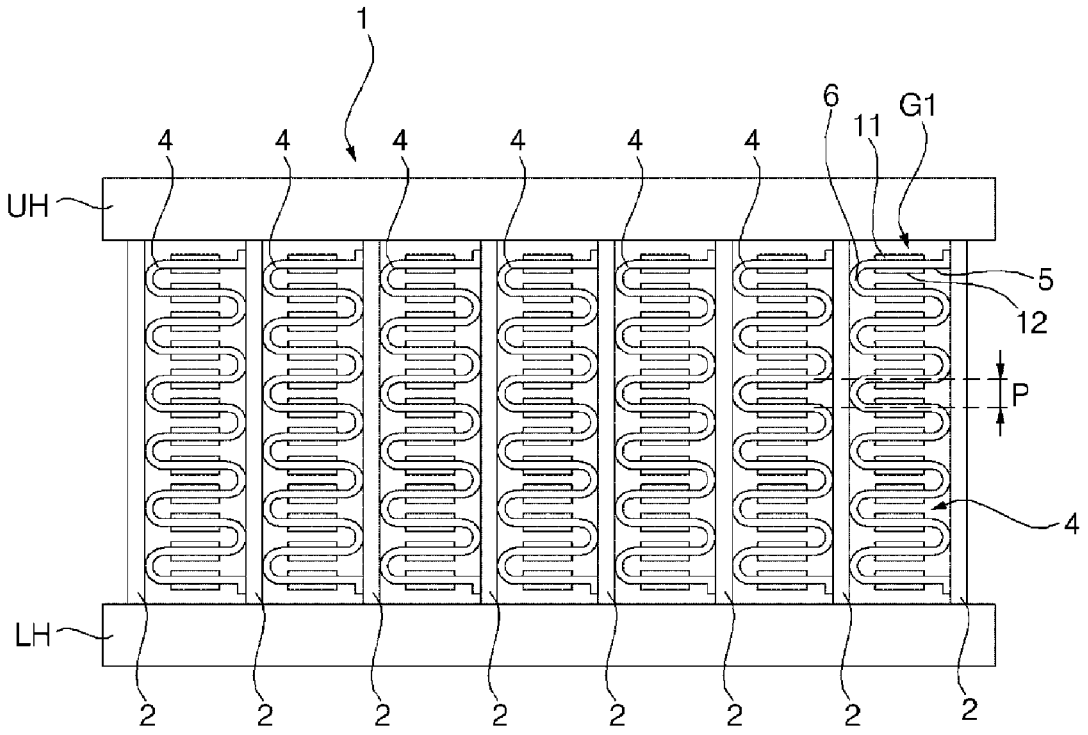
FIG. 3 is a front view of an embodiment of the heat exchanger according to the present invention.
Figure 4:
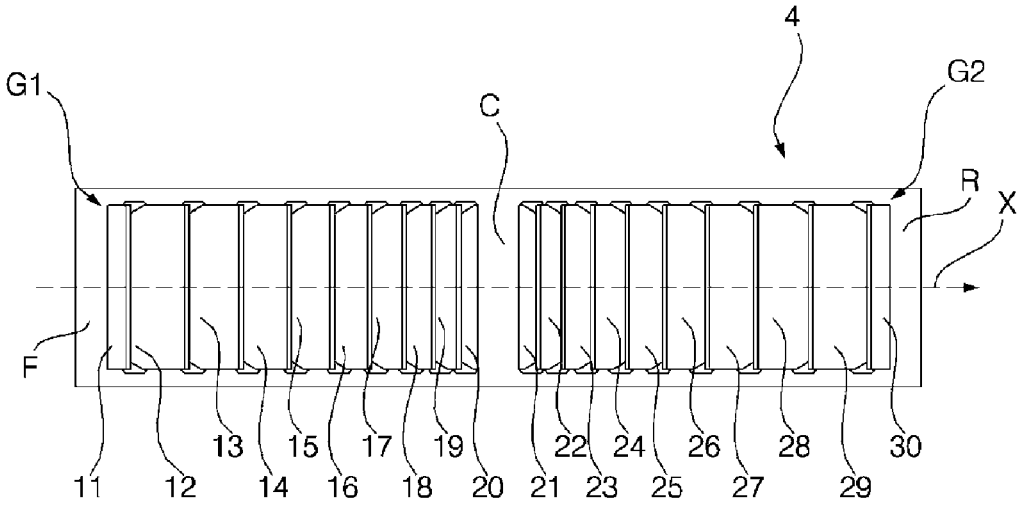
FIG. 4 is a cross-sectional view showing a fin of an embodiment of the heat exchanger according to the present invention.
Figure 5:
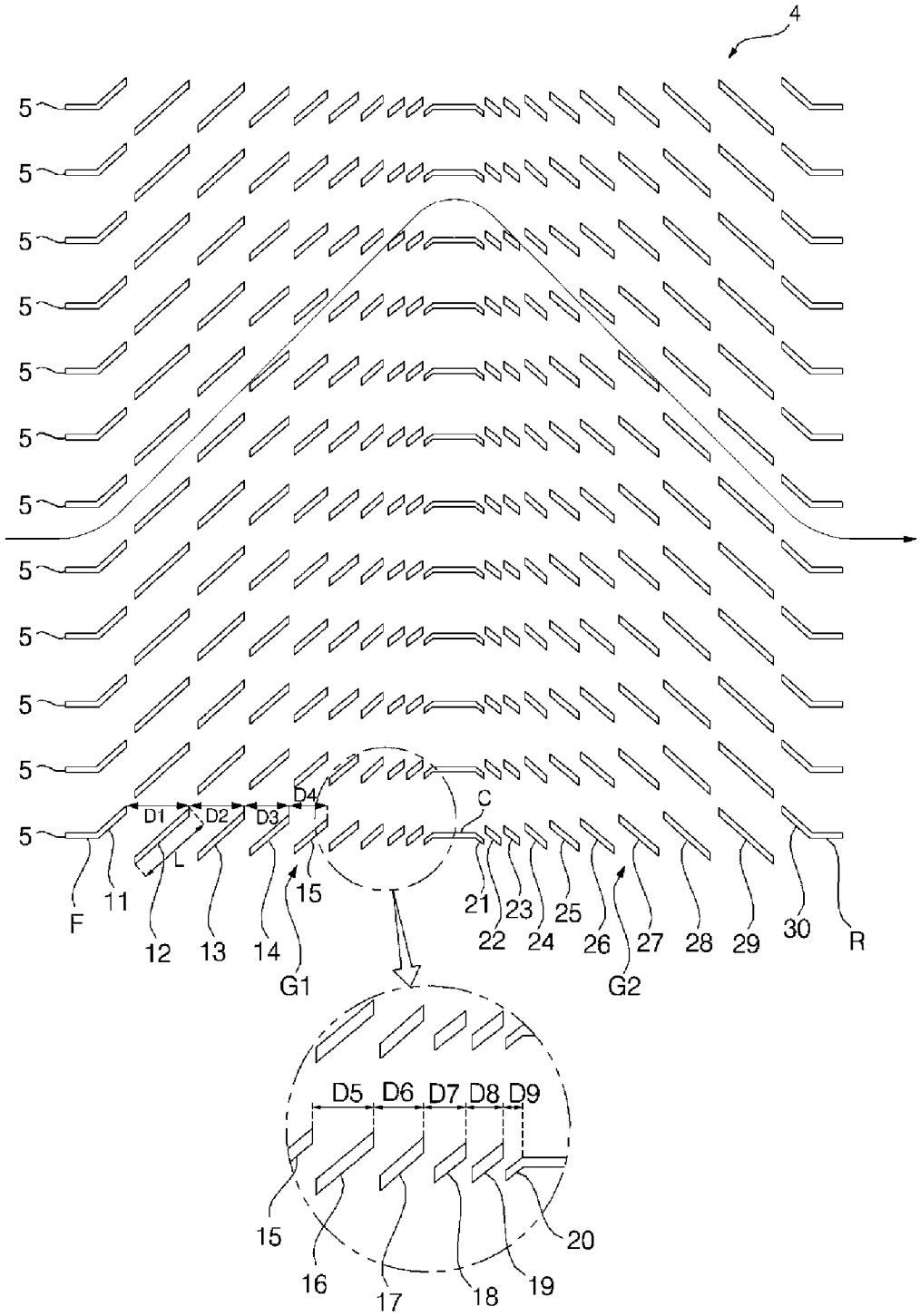
FIG. 5 is a plan view showing the fin of an embodiment of the heat exchanger according to the present invention.

FIG. 2 is a partially cut-away perspective view of an embodiment of the heat exchanger according to the present invention, FIG. 3 is a front view of an embodiment of the heat exchanger according to the present invention, FIG. 4 is a cross-sectional view showing a fin of an embodiment of the heat exchanger according to the present invention, and FIG. 5 is a plan view showing the fin of an embodiment of the heat exchanger according to the present invention.

The heat exchanger 1 of the present embodiment includes a tube 2 through which a refrigerant passes and a fin 4 coming into contact with the tube 2. A plurality of louvers 11~20 is formed in the fin 4.

The tube 2 may be lengthily formed in an up and down direction Y, that is, a direction orthogonal to a direction X in which air flows. The tube 2 may be formed in a plate body form. A plurality of channels through which a refrigerant passes may be formed in the tube 2. The tube 2 may be a heat electric plate or multi-flow electric heat tube having a multi-flow channel. The plurality of channels may be spaced apart from each other in a direction parallel to the direction X in which air flows. The heat exchanger 1 may include a plurality of the tubes 2. The plurality of tubes 2 may be disposed in parallel. The plurality of tubes 2 may be spaced apart from each other in a direction Z orthogonal to the direction X in which air flows and the length direction Y of the tubes 2. A space through which air can flow may be formed between the plurality of tubes 2, and the fin 4 may be located in the space between the plurality of tubes 2. If the direction X in which air flows through the heat exchanger 1 is a front and back direction, each of the plurality of tubes 2 may be lengthily disposed in the up and down direction and the plurality of tubes 2 may be spaced apart from each other in the left and right direction. An air conditioner may include one or more headers with which the plurality of tubes 2 communicates, respectively. The air conditioner may further include an upper head UH with which one end of each of the plurality of tubes 2 communicates and a lower head LH with which the other end of each of the plurality of tubes 2 communicates. A refrigerant in the upper head UH may flow into the lower head LH through the plurality of channels formed in each of the plurality of tubes 2. In contrast, a refrigerant in the lower head LH may flow into the upper head UH the plurality of channels formed in each of the plurality of tubes 2.

The fin 4 may be lengthily formed in the direction X in which air flows through the heat exchanger 1. The fin 4 may include a fin unit 5 lengthily formed in the direction X in which air flows through the heat exchanger 1. At least part of the fin unit 5 may be horizontally disposed between a plurality of the tubes 2. The entire fin unit 5 may be horizontally disposed between the plurality of tubes 2. Only part of the fin unit 5 may be located between the plurality of tubes 2, and the remaining part may be located at another place other than between the plurality of tubes 2. If the direction X in which air flows through the heat exchanger 1 is the front and back direction, the fin unit 5 may be lengthily formed in the front and back direction in the direction X in which air flows through the heat exchanger 1. The fin 4 may include a plurality of the fin units 5, and the plurality of fin units 5 may be spaced apart from each other at a specific fin pitch P. The plurality of fin units 5 may be spaced apart from each other in the up and down direction. The fin 4 may include a connection part 6 that connects the fin unit located on the upper side and the fin unit located on the lower side. The fin units 5 and connection parts 6 of the fin 4 may be disposed between a pair of the tubes that face each other in zigzags as shown in FIG. 2.

The plurality of louvers 11~20 may be formed in such a way as to be spaced apart from each other in the direction X in which air flows. The plurality of louvers 11~20 may be sequentially formed in the direction X in which air flows. The plurality of louvers 11~20 may be spaced apart from each other at different intervals. The plurality of louvers 11~20 may be bent to have a tilt angle of an obtuse angle with respect to a horizontal plane. The plurality of louvers 11~20 may be formed in parallel. All of the plurality of louvers 11~20 may be bent and formed at the same tilt angle. The interval between two louvers that belong to the plurality of louvers 11~20 and that are adjacent to each other in the direction X in which air flows through the heat exchanger 1 may be different. The interval between two louvers that belong to the plurality of louvers 11~20 and that are adjacent to each other may be gradually reduced toward the slipstream of the direction X in which air flows. The interval D between the plurality of louvers 11~20 may be gradually reduced at a rate of 10% to 20% in the direction X in which air flows through the heat exchanger 1.

A first interval D1 may be formed between the first louver 11 that belongs to the plurality of louvers 11~20 and that is first subjected to thermal exchange with air and the second louver 12 next to the first louver 11 in the direction X in which air flows. A second interval D2 may be formed between the second louver 12 and the third louver 13 next to the second louver 12 in the direction X in which air flows. The first interval D1 may be greater than the second interval D2. Furthermore, a third interval D3 may be formed between the third louver 13 and the fourth louver 14 next the third louver 13 in the direction X in which air flows. The second interval D2 may be greater than the third interval D3. Likewise, the intervals D1~D9 between the plurality of louvers 11~20 may be gradually reduced toward the slipstream of the direction X in which air flows.

The length L of some of the plurality of louvers 11~20 may be shorter toward the slipstream of the direction X in which air flows through the heat exchanger 1. The length L of the first louver 11 that belongs to the plurality of louvers 11~20 and that is located at the foremost in the direction in which air flows through the heat exchanger and subsequent louvers 11~20 may be shorter toward the backside of the direction X in which air flows through the heat exchanger 1.

The first louver 11 that belongs to the plurality of louvers 11~20 and that is located at the foremost in the direction in which air flows through the heat exchanger 1 and the tenth louver 20 located at the slipstream may be semi-louvers. Louvers between the first louver 11 and the tenth louver 20 may be full louvers. In this case, the semi-louver is a louver which has been bent in such a way as to be protruded in any one of the upward slope direction and downward slope direction of a horizontal plane. The full louver is a louver which has been bent in such a way as to be protruded in both the upward slope direction and downward slope direction of the horizontal plane.

The length of the second louver 12 that belongs to the plurality of louvers 11~20 and that is located next to the first louver 11 may be longer than the length of the subsequent louvers 13~20. The length of the louvers may be gradually reduced from the second louver 12 to the slipstream.

Meanwhile, a first louver group G1 including the plurality of louvers 11~20 spaced apart from each other in the direction in which air flows and a second louver group G2 including a plurality of louvers 21~30 located at the slipstream compared to the first louver group G1 and spaced apart from each other in the direction in which air flows may be formed in the fin 4. In this case, the first louver group G1 may become a front column louver group located between the front parts of the tubes 2, and the second louver group G2 may become a back column louver group located between the rear parts of the tubes 2.

Meanwhile, the heat exchanger 1 may include a plurality of first tubes 2 through which a refrigerant passes and which is long in the up and down direction and a plurality of second tubes 3 through which a refrigerant passes and which is spaced apart from the first tubes 2 in the slipstream of the first tubes 2 in the direction X in which air flows and long in the up and down direction. The fins 4 may come into contact with the first tubes 2 and the second tubes 3 and may be a rectangle in the direction X in which air flows. In the heat exchanger, the front parts of the plurality of first tubes 2 and the fins 4 may form a first column heat exchange unit. The rear parts of the plurality of second tubes 3 and the fins 4 may form a second column heat exchange unit. The first column heat exchange unit and the second column heat exchange unit may be connected through the middle parts of the fins 4. In this case, the fins 4 may be common fins that form the first column heat exchange unit and the second column heat exchange unit.

If the heat exchanger 1 includes the plurality of first tubes 2 and the plurality of second tubes 3, the first louver group G1 including the plurality of louvers 11~20 located between the plurality of first tubes 2 and spaced apart from each other in the direction in which air flows may be formed in the fin 4. The second louver group G2 including the plurality of louvers 21~30 located between the plurality of second tubes 3 and spaced apart from each other in the direction in which air flows may be formed in the fin 4.

The interval between adjacent louvers of the plurality of louvers 11~20 of the first louver group G1 may be gradually narrowed toward the slipstream of the direction in which air flows through the heat exchanger 1. The interval between the plurality of louvers 11~20 of the first louver group G1 may be gradually reduced at a ratio of 10% to 20%. Some louvers 12~20 of the plurality of louvers 11~20 of the first louver group G1 may have a shorter length toward the slipstream of the direction in which air flows through the heat exchanger 1. The plurality of louvers 11~20 of the first louver group G1 may guide air in the upward slope direction.

The fin 4 may be formed to have a structure in which the first louver group G1 and the second louver group G2 are symmetrical to each other on the basis of the center of the direction in which air flows through the heat exchanger 1. The interval between adjacent louvers of the plurality of louvers 21~30 of the second louver group G2 may be gradually widened toward the slipstream of the direction in which air flows through the heat exchanger 1. The interval between the plurality of louvers 21~30 of the second louver group G2 may be gradually increased at a ratio of 10% to 20%. The length of some 22~30 of the plurality of louvers 21~30 of the second louver group G2 may be increased toward the slipstream of the direction in which air flows through the heat exchanger 1. The plurality of louvers 21~30 of the second louver group G2 may guide air in the downward slope direction.

A front flat plate unit F, the plurality of louvers 11~20 of the first louver group G1, a center flat plate unit C, the plurality of louvers 21~30 of the second louver group G2, and a rear flat plate unit R may be sequentially formed in the fin 4 in the direction X in which air flows through the heat exchanger 10. When air flows through the heat exchanger 1, it may be guided into the front flat plate unit F and then guided by the plurality of louvers 11~20 of the first louver group G1. Thereafter, after the air is guided by the center flat plate unit C, it may be guided by the plurality of louvers 21~30 of the second louver group G2 and may be finally guided into the rear flat plate unit R.

When air flows between the plurality of louvers 11~20 of the first louver group G1, the direction in which the air flows may be changed upward by the plurality of louvers 11~20 of the first louver group G1. When the air flows through the center flat plate unit C, the direction in which the air flows may be changed approximately horizontally. Thereafter, when the air flows between the plurality of louvers 21~30 of the second louver group G2, the direction in which the air flows may be changed downward by the plurality of louvers 21~30 of the second louver group G2. Finally, the air may be guided into the rear flat plate unit R and discharged in the horizontal direction. When air flows through the heat exchanger 1, it may flow through the heat exchanger 1 according to a flow characteristic in which the air generally rises upward and then falls.

Figure 6:
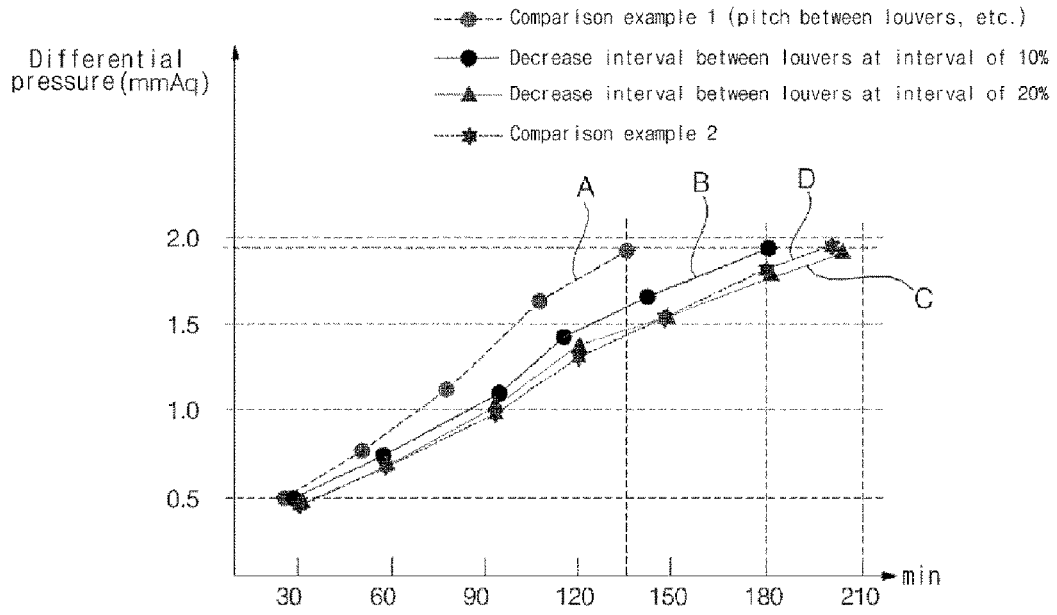
FIG. 6 is a diagram showing a comparison between a change in the frost attachment time and differential pressure of an embodiment of the heat exchanger according to the present invention and a change in the frost attachment time and differential pressure of a comparison example.

FIG. 6 is a graph showing a change in differential pressure over time in an embodiment of the heat exchanger according to the present invention and a change in differential pressure over time in a comparison example.

A change in differential pressure over time shown in FIG. 6 is the results of experiments performed in the condition in which all of other conditions, such as the size of a heat exchanger or a refrigerant tube, other than the interval between the louvers are the same condition.

A comparison example 1 is a case A in which all of the intervals between the plurality of louvers are constant. Referring to FIG. 6, in the case of the comparison example 1, it may be seen that after a cooling operation starts, the time taken for differential pressure before and after the heat exchanger to reach 2.0 mmAq is about 130 minutes.

In the case of a case B where the interval between the louvers is reduced at an interval of 10%, it may be seen that after a cooling operation starts, the time taken for differential pressure before and after the heat exchanger to reach 2.0 mmAq is about 180 minutes. If the interval between the louvers is reduced at an interval of 10%, the cooling operation time can be increased and the number of defrosting operations can be reduced compared to the comparison example 1.

In the case of a case C where the interval between the louvers is reduced 20%, it may be seen that after a cooling operation starts, the time taken for differential pressure before and after the heat exchanger to reach 2.0 mmAq is approximately 200 minutes. If the interval between the louvers is reduced at an interval of 20%, the cooling operation time can be increased and the number of defrosting operations can be reduced compared to the comparison example 1.

A comparison example 2 is a case C where the interval between the louvers is reduced at an interval of 30%. It may be seen that after a cooling operation starts, the time taken for differential pressure before and after the heat exchanger to reach 2.0 mmAq is approximately 195 minutes. If the interval between the louvers is reduced at an interval of 30%, the cooling operation time can be increased and the number of defrosting operations can be reduced compared to the comparison example 1.

Figure 7:
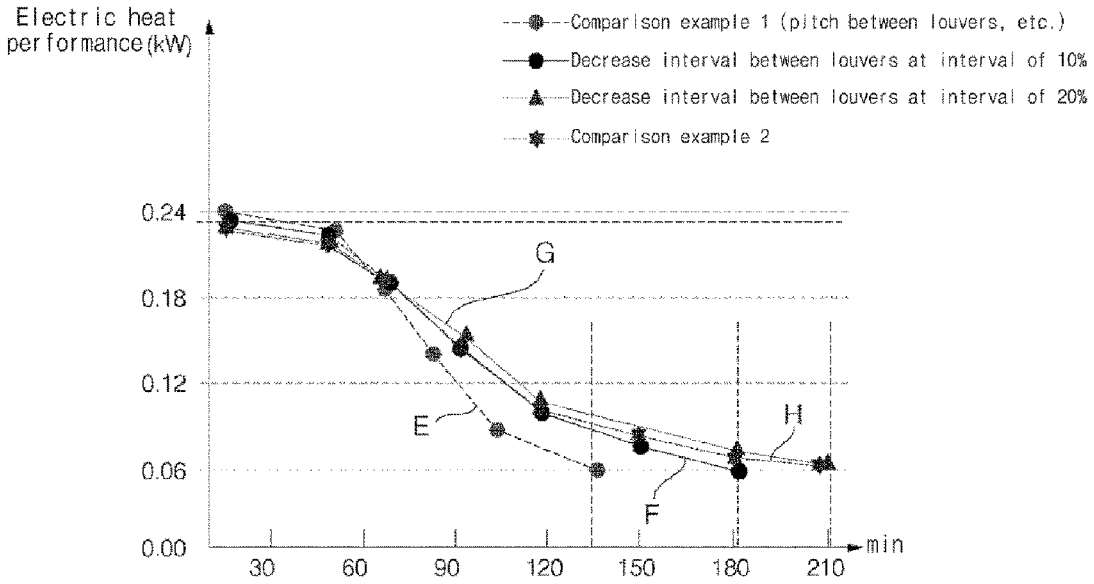
FIG. 7 is a diagram showing a comparison between a change in the frost attachment time and electric heat performance of an embodiment of the heat exchanger according to the present invention and a change in the frost attachment time and electric heat performance of a comparison example.

FIG. 7 is a diagram showing a change in electric heat performance over time in an embodiment of the heat exchanger according to the present invention and electric heat performance over time in a comparison example.

A change in the performance of electric heat over time shown in FIG. 7 is the results of experiments performed in the condition in which all of other conditions, such as the size of a heat exchanger or a refrigerant tube, other than the interval between the louvers are the same condition.

A comparison example 1 is a case E where all of the interval between the plurality of louvers are constant. In such a case, it may be seen that after a cooling operation starts, electric heat performance is low with 0.06 kW in about 130 minutes.

In a case F where the interval between the louvers is reduced at an interval of 10%, it may be seen that electric heat performance reaches 0.06 kW in about 180 minutes after the start of a cooling operation and electric heat performance is 0.1 kW and higher than that of the comparison example 1 compared to 130 minutes of the comparison example 1.

In a case G in which the interval between the louvers is reduced at an interval of 20%, it may be seen that electric heat performance reaches 0.06 kW in about 210 minutes after the start of a cooling operation and electric heat performance is 0.1 kW or more and higher than that of the comparison example 1 compared to 130 minutes of the comparison example 1.

A comparison example 2 is a case H where the interval between the louvers is reduced at an interval of 30%. It may be seen that the case H generally has electric heat performance similar to that of a case G where the interval between the louvers at an interval of 20%, but has electric heat performance lower than that of the case G where the interval between the louvers is reduced at an interval of 20% in some time zones 70 minutes~120 minutes after the start of a cooling operation.

INDUSTRIAL APPLICABILITY

The present invention may be used in cooling and heating apparatuses and all of air conditioners in which a heat exchanger, such as a heat pump, is used and a heat exchanger in which thermal exchange is performed between a refrigerant and air or various fluids.

The invention claimed is:

1. A heat exchanger, comprising:

a plurality of first tubes and a plurality of second tubes through which a refrigerant passes therein and which are lengthily formed up and down, each of the first tubes and the second tubes being spaced apart from each other and air flowing between the tubes; and a fin coming into contact with the first tube and the second tube, wherein the plurality of second tubes is spaced apart from each other and located at a slipstream of the plurality of first tubes in a direction in which air flows, a first louver group comprising a plurality of louvers located between the plurality of first tubes and spaced apart from each other in the direction in which air flows and a second louver group comprising a plurality of louvers located between the plurality of second tubes and spaced apart from each other in the direction in which air flows are formed in the fin, and an interval between adjacent louvers of the plurality of louvers of the first louver group is gradually narrowed toward a slipstream of the direction in which air flows, wherein the plurality of louvers of the first louver group guides air in an upward slope direction, and the plurality of louvers of the second louver group guides air in a downward slope direction, wherein some of the plurality of louvers of the first louver group have a length which is shorter toward the slipstream of the direction in which air flows, wherein an interval between adjacent louvers of the plurality of louvers of the second louver group is gradually widened toward the slipstream of the direction in which air flows, wherein some of the plurality of louvers of the second louver group have a length which is longer toward the slipstream of the direction in which air flows.

2. The heat exchanger of claim 1, wherein the interval between the plurality of louvers of the first louver group is gradually reduced at a ratio of 10% to 20% toward the slipstream of the direction in which air flows.

3. A heat pump, comprising:

a compressor which compresses a refrigerant;

an outdoor heat exchanger which thermally exchanges the refrigerant with outside air;

an indoor heat exchanger which thermally exchanges the refrigerant with indoor air;

an expansion device which is disposed between the heat exchanger and the indoor heat exchanger; and a cooling and heating switchover valve which runs the refrigerant compressed by the compressor toward the heat exchanger or toward the indoor heat exchanger, wherein the outdoor heat exchanger comprises:

a plurality of first tubes and a plurality of second tubes through which a refrigerant passes therein and which are lengthily formed up and down, each of the first tubes and the second tubes being spaced apart from each other and outside air flowing between the tubes; and a fin coming into contact with the first tube and the second tube, wherein the plurality of second tubes is spaced apart from each other and located at a slipstream of the plurality of first tubes in a direction in which outside air flows, a first louver group comprising a plurality of louvers located between the plurality of first tubes and spaced apart from each other in the direction in which outside air flows and a second louver group comprising a plurality of louvers located between the plurality of second tubes and spaced apart from each other in the direction in which outside air flows are formed in the fin, and an interval between adjacent louvers of the plurality of louvers of the first louver group is gradually narrowed toward a slipstream of the direction in which outside air flows, wherein the plurality of louvers of the first louver group guides air in an upward slope direction, and the plurality of louvers of the second louver group guides air in a downward slope direction, wherein some of the plurality of louvers of the first louver group have a length which is shorter toward the slipstream of the direction in which air flows, wherein an interval between adjacent louvers of the plurality of louvers of the second louver group is gradually widened toward the slipstream of the direction in which air flows, wherein some of the plurality of louvers of the second louver group have a length which is longer toward the slipstream of the direction in which air flows.

4. The heat pump of claim 3, wherein the interval between the plurality of louvers of the first louver group is gradually reduced at a ratio of 10% to 20% toward the slipstream of the direction in which outside air flows.

* * * * *